United States Patent [19]

Zinn

[11] Patent Number: 4,923,408

[45] Date of Patent: May 8, 1990

[54] MULTIPOLE ELECTRIC PLUG AND SOCKET

[75] Inventor: Bernd Zinn, Ennepetal, Fed. Rep. of Germany

[73] Assignee: Grote & Hartmann GmbH & Co. KG, Fed. Rep. of Germany

[21] Appl. No.: 268,813

[22] Filed: Nov. 8, 1988

[30] Foreign Application Priority Data

Nov. 13, 1987 [DE] Fed. Rep. of Germany ..... 3738593

[51] Int. Cl.[5] ..... H01R 4/50

[52] U.S. Cl. ..... 439/341; 439/357; 439/686; 439/701

[58] Field of Search ..... 439/357, 341, 367, 499, 439/686, 689, 695, 701

[56] References Cited

U.S. PATENT DOCUMENTS

| | | | |
|---|---|---|---|
| 4,082,400 | 4/1978 | Gansert | 439/341 |
| 4,257,665 | 3/1981 | John et al. | 439/677 X |
| 4,738,632 | 4/1988 | Schmidt et al. | 439/341 |

OTHER PUBLICATIONS

IBM Bulletin, vol. 15, No. 1, 6-1972, p. 108, K. R. Dust, 439/701.

*Primary Examiner*—Neil Abrams
*Assistant Examiner*—Khiem Nguyen
*Attorney, Agent, or Firm*—Jones, Askew & Lunsford

[57] ABSTRACT

This invention concerns a multipole electric plug and socket device consisting of a plug enclosure and a socket box enclosure in which there are contact elements and mating contact elements connected to electric lines and accommodated in appropriate compartments, where the enclosure can be connected to a pivot hinge device and can be locked with a catch mechanism opposite the pivot hinge device, and box-shaped magazines having contact elements compartments can be inserted into the plug enclosure and/or the socket box enclosure, and these magazines have catch devices that interlock with mating catch devices on the housing walls, and the plug enclosure has an insertion orifice for frontal insertion of magazines at the front.

15 Claims, 6 Drawing Sheets

41
28
40
55
27
16
31
57
30
56
55
15
57
24
61
62
18
17
53
58
54
53
59
13
42
44
41
40
58
54
53
59
42
44
4
10

MULTIPOLE ELECTRIC PLUG AND SOCKET

BACKGROUND OF THE INVENTION

This invention concerns a multipole electric plug and socket consisting of a plug enclosure and a socket box in which contact elements and mating contact elements connected to electric lines are accommodated in appropriate compartments, and the enclosure can be connected to a pivot hinge device and can be locked with a catch mechanism opposite the pivot hinge device, and box-shaped magazines that have contact element compartments and catch elements that lock with mating catch devices on the walls of the enclosure can be inserted into the plug enclosure and/or the socket box.

Such a plug and socket device is known, e.g., from German Utility Patent No. 8,627,007. A disadvantage of such devices is that the enclosure has subdivided fixed spaces into which only magazines with corresponding dimensions and shape can be inserted, namely from the longitudinal side or from the top or bottom. However, such plug and socket devices are supposed to be available with the same enclosure but with different magazines or with different plug configurations for various purposes, the versatility of the known plug and socket device is relatively limited in this regard. Furthermore, changing the magazine is relatively time consuming and the shape of the enclosure is complicated.

SUMMARY OF THE INVENTION

The problem on which the present invention is based is to expand the scope of such plug and socket devices, to simplify the shape of the enclosure and facilitate the operation of exchanging magazines.

This invention is explained in greater detail below on the basis of the practical examples illustrated in the FIGS. which show the following.

DESCRIPTION OF THE PREFERRED EMBODIMENTS

Figures 1, 2:
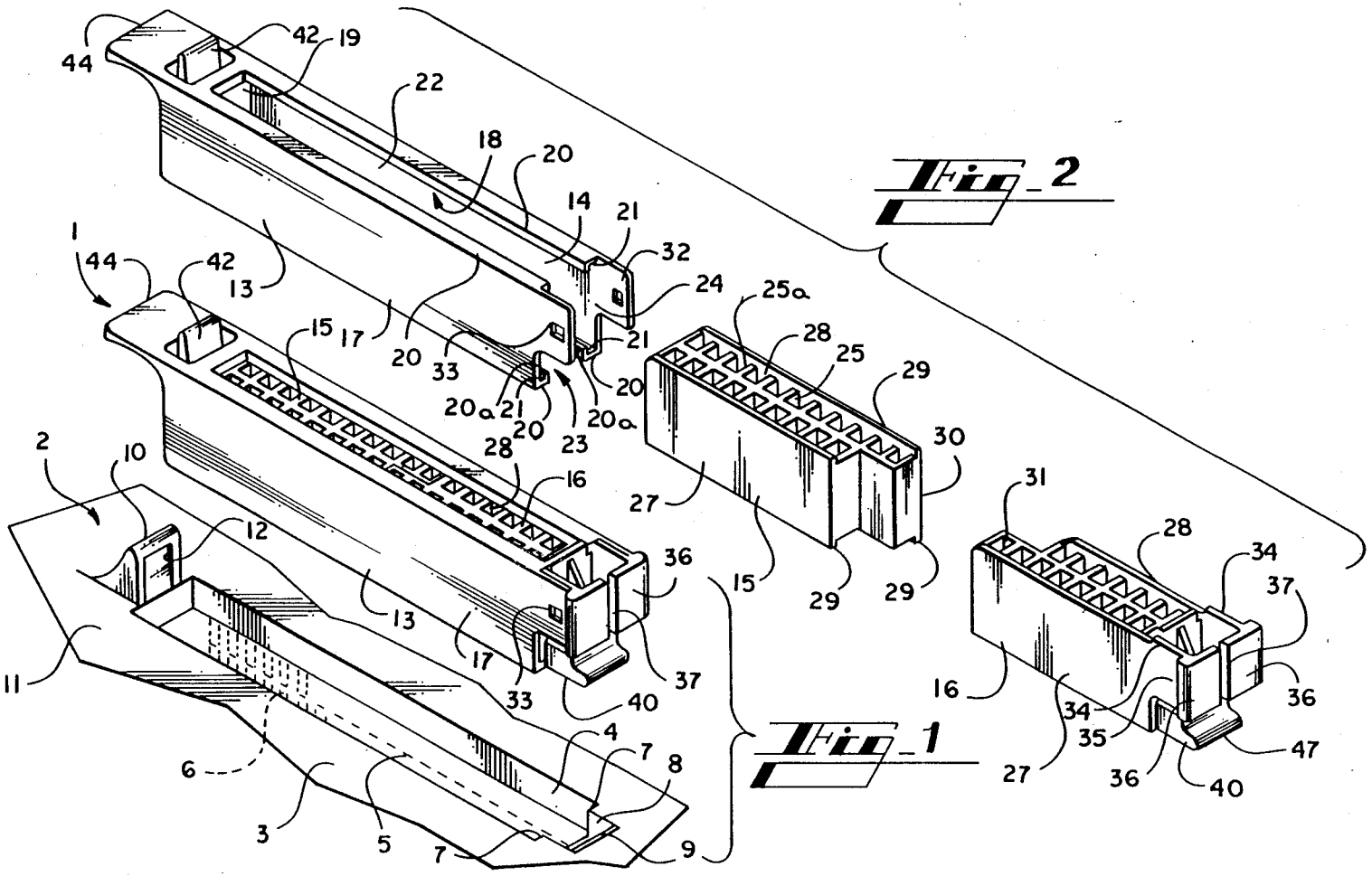
FIG. 1 shows a perspective view of a first version of the plug and socket device.
FIG. 2 shows an exploded diagram of the plug enclosure of the plug and socket device according to FIG. 1.
Figure 3:
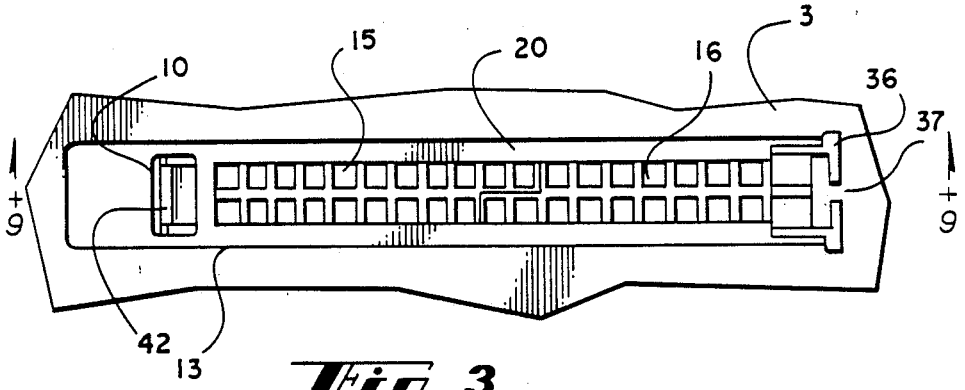
FIG. 3 shows a top view of the plug and socket device according to FIG. 1.
Figure 4:
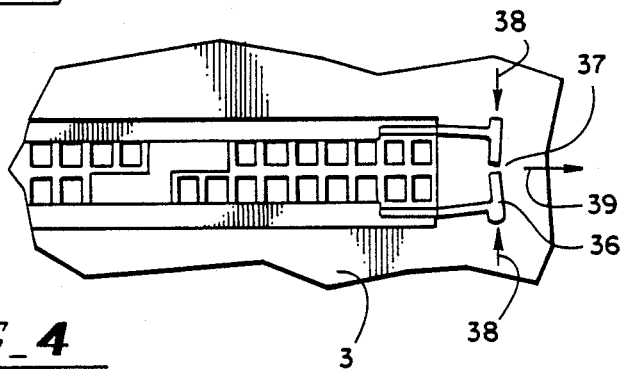
FIG. 4 shows a top view of the catch mechanism of the plug and socket device according to FIG. 1.

The multipole electric plug and socket device consists essentially of plug 1 and socket box 2.

Socket box 2 has a socket box enclosure 3 of which only the essential parts are shown to illustrate this invention, with a box-shaped contact pin box 4 that has plug pins 6 projecting out of its bottom 5. A step edge 7 is provided in contact pin box 4 on both sides at the front end with a hinge recess 8 extending forward out of it with a hinge piece 9 extending across the longitudinal extent of pin box 4 at the top.

A catch block 10 is provided on the rear end of pin box 4 opposite hinge recess 8 and projects above the surface 11 of the socket box enclosure 3 and is provided with an undercut catch ridge 12 running across the longitudinal extent of box 4 in the upper end area of the box.

Plug 1 is designed as a plug enclosure 13 with an approximately box-shaped outer contour with magazines 15, 16 held in the interior 14. Plug enclosure 13 has the two side walls 17, 18 which extend forward from the rear wall 19 in a fork shape. Angle bars 20 designed so they are identical at the top and bottom sides toward the interior space 14 are provided on side walls 17 and 18, so their angle recess 21 faces toward the interior space 14. Between the upper angle bars and the lower angle bars 21, plug enclosure 13 is open so there is an upper rectangular opening 22 and a lower rectangular opening 23. At the front, plug enclosure 13 has an insertion orifice 24.

It is essential to the nature of this invention that the magazines 15, 16 with a box-shaped outer contour can be inserted into the interior space 14 from insertion orifice 24. Two magazines are shown, but more magazines may also be used, e.g., three smaller magazines or, for example, one magazine 15 or 16 and two smaller magazines or only a single magazine corresponding to the entire length of interior space 14. This possibility did not exist with the previously known plug and socket devices. Frontal insertion makes this versatility possible for the first time.

Figure 6:
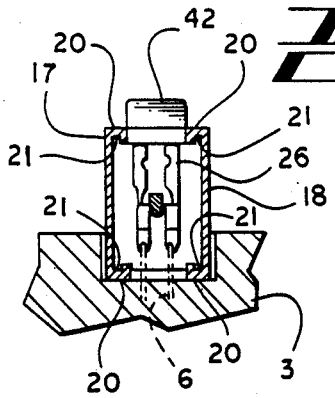
FIG. 6 shows a section along line A—B in FIG. 5 as seen in the direction of the arrow.
Figure 7:
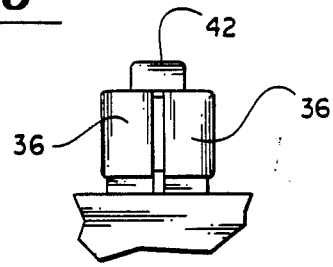
FIG. 7 shows a frontal view of the plug and socket device according to FIG. 1.
Figure 8:
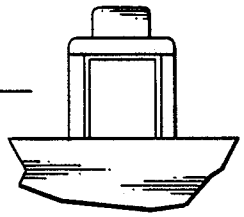
FIG. 8 shows a rear view of the plug and socket device according to FIG. 1.

Magazines 15, 16 have compartments 25 to receive contact elements 26 (FIG. 6). They have bar pieces 29 at the top and bottom in the extension of side walls 27, 28 that fit by interlocking into angle recesses 21 of angle bars 20 so the free end edges **20*a* of angle bars 20 rest on the upper edges 25*a* of the walls of compartments 25. Due to this design of the mount of the magazine, a stable self-supporting plug 1 can be produced from uncomplicated shapes that are easy to produce and require little material despite the unstable fork-shaped design of plug enclosure 13**.

To further increase the stability and torsional stiffness of plug 1, another measure provides for one magazine 15 to have a projection 30 parallel with the longitudinal axis that forms one half and the other magazine 16 to have a projection 31 that forms the mating half, so they supplement each other when locked together to form the box shape of the magazine. Projections 30 and 31 can be provided with compartments 25 as illustrated here.

Tabs 32 are provided on the front end of side walls 17, 18 of plug enclosure 13 and are aligned with locking holes 33 that form part of the catch lock mechanism for the magazines 15, 16. The other part consists of tabs 34 that are attached to the side walls 27, 28 of magazine 16 at the front and have catch noses 35 on the outside that can lock into catch holes 33. Grip pieces 36 are provided at the end of tabs 34, extending across them and forming a slit 37 between them. By pressing grip pieces 36 in the direction of arrow 38 toward slit 37, magazine 16 can be unlocked and removed from plug enclosure 13 in the direction of arrow 39. Magazine 15 can then be slipped out.

Figure 9:
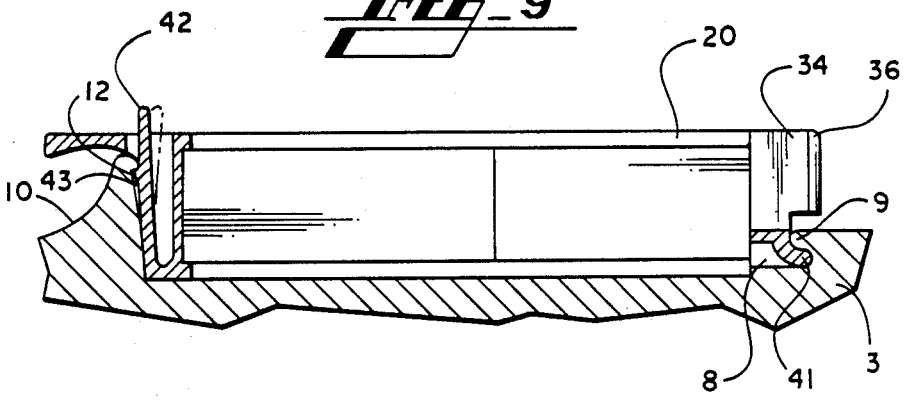
FIG. 9 shows a section along line C—D in FIG. 3 without the magazine as seen in the direction of the arrow.

Tabs 32 and 34 do not take up the entire width of walls 17, 18 or 27, 28. Below tabs 34 there is a hinge tongue 40 that extends forward and a mating hinge tongue 41 which can lock under hinge piece 9 of socket box enclosure 3 (FIG. 9) when the plug enclosure is moved out of the position illustrated with a dotted line in FIG. 5 into the position illustrated with a solid line into the pin box 4 of the socket box enclosure 3.

Figure 5:
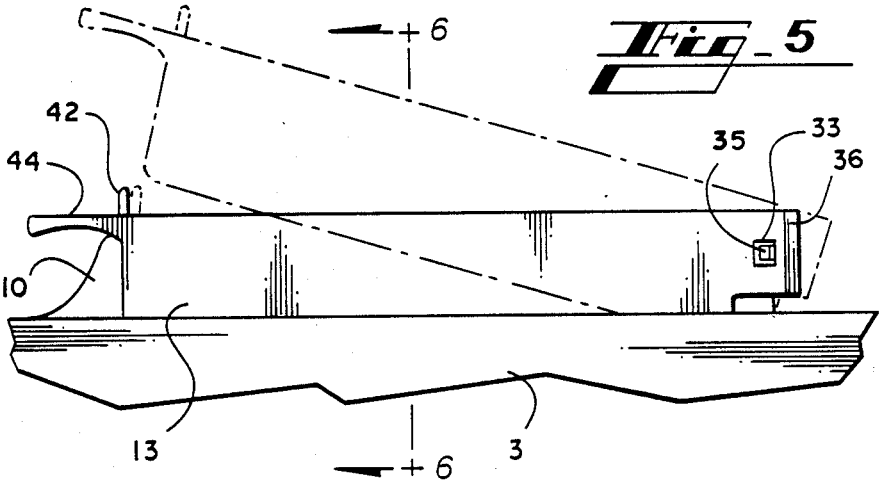
FIG. 5 shows a side view of the plug and socket device according to FIG. 1.

To interlock with catch block 10 of socket box enclosure 3, there is a spring tongue 42 projecting upward at the rear end of plug enclosure 13 from the bottom area with a catch nose piece 43 that locks into the undercut recess 12 when plug enclosure 13 is inserted into pin box 4 and moved according to FIG. 5.

It is advantageous for a grip plate 44 running toward the rear to be provided on the rear end of plug enclosure 13. This grip plate has a hole through which spring tongue 42 reaches from the upper area. Plug enclosure 13 can easily be unlocked by hand.

Figure 10:
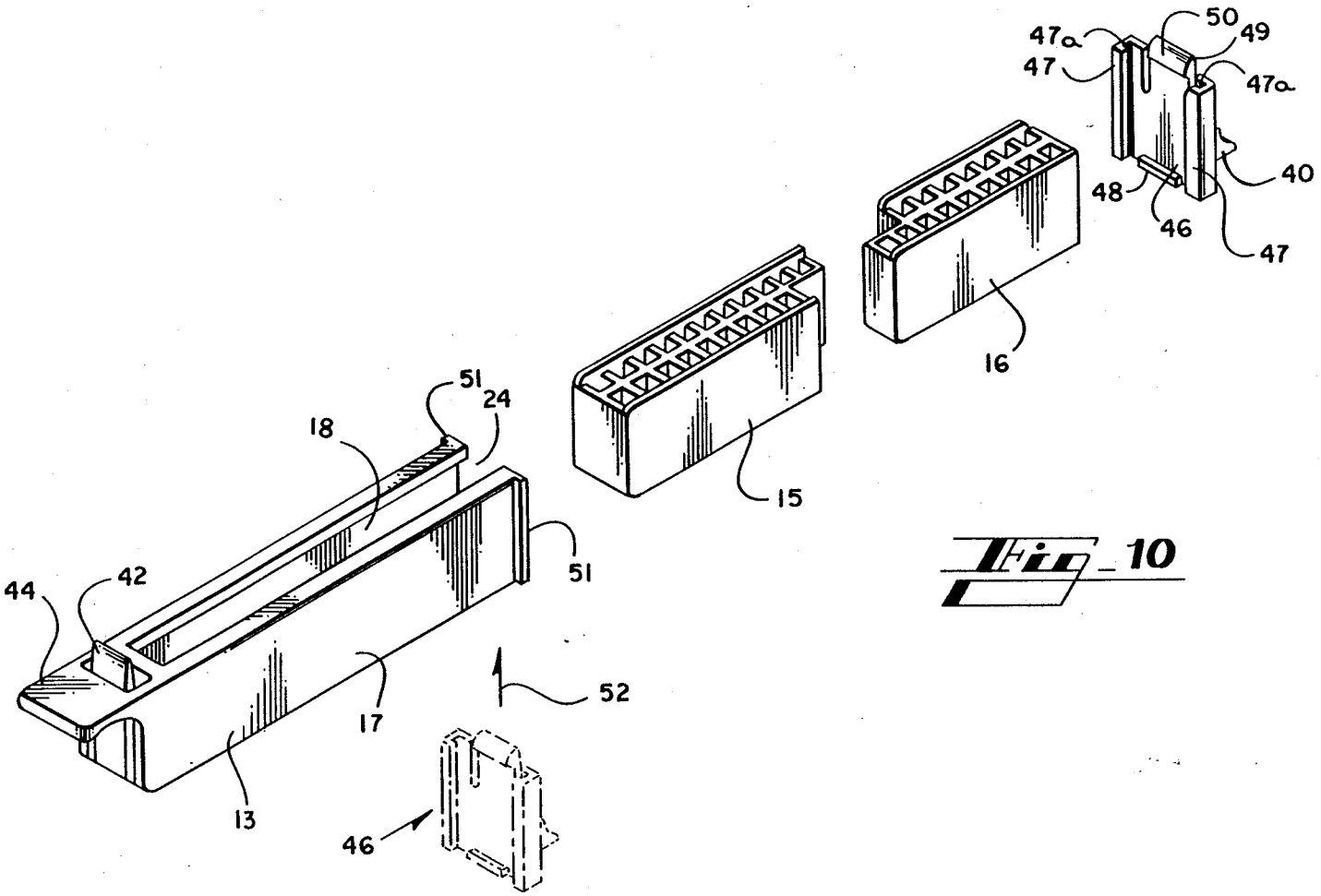
FIG. 10 shows an exploded diagram of one version of the plug enclosure.

FIG. 10 shows a simplified version of plug enclosure 13 with magazines 15, 16. The magazines 15, 16 can be designed so they are the same because a closing wall 46 assumes the function of the stop catch mechanism for the magazine with plug enclosure 13. Wall 46 has two vertical angle bars 47 extending in the direction of enclosure 13, and a stop piece 48 that projects in the direction of enclosure 13 is provided on the lower edge of wall 46 and a catch spring tongue 49 is exposed with a catch spring nose in the area of the upper edge. Wall 46 has hinge tongue 40 on the outside. Vertical bar pieces 51 running across the longitudinal extent of the enclosure and extending outward are provided on the end of side walls 17, 18 as the outer support for wall 46. These bar pieces lock into bar recesses 47*a* of angle bars 47. The closing wall 46 can be pushed in the direction of arrow 52 onto plug enclosure 13 until stop piece 48 strikes the lower edge of plug enclosure 13. Then catch spring nose 50 springs over the upper edge of the plug enclosure so the opening 24 of the plug enclosure 13 is locked.

Figures 11, 12:
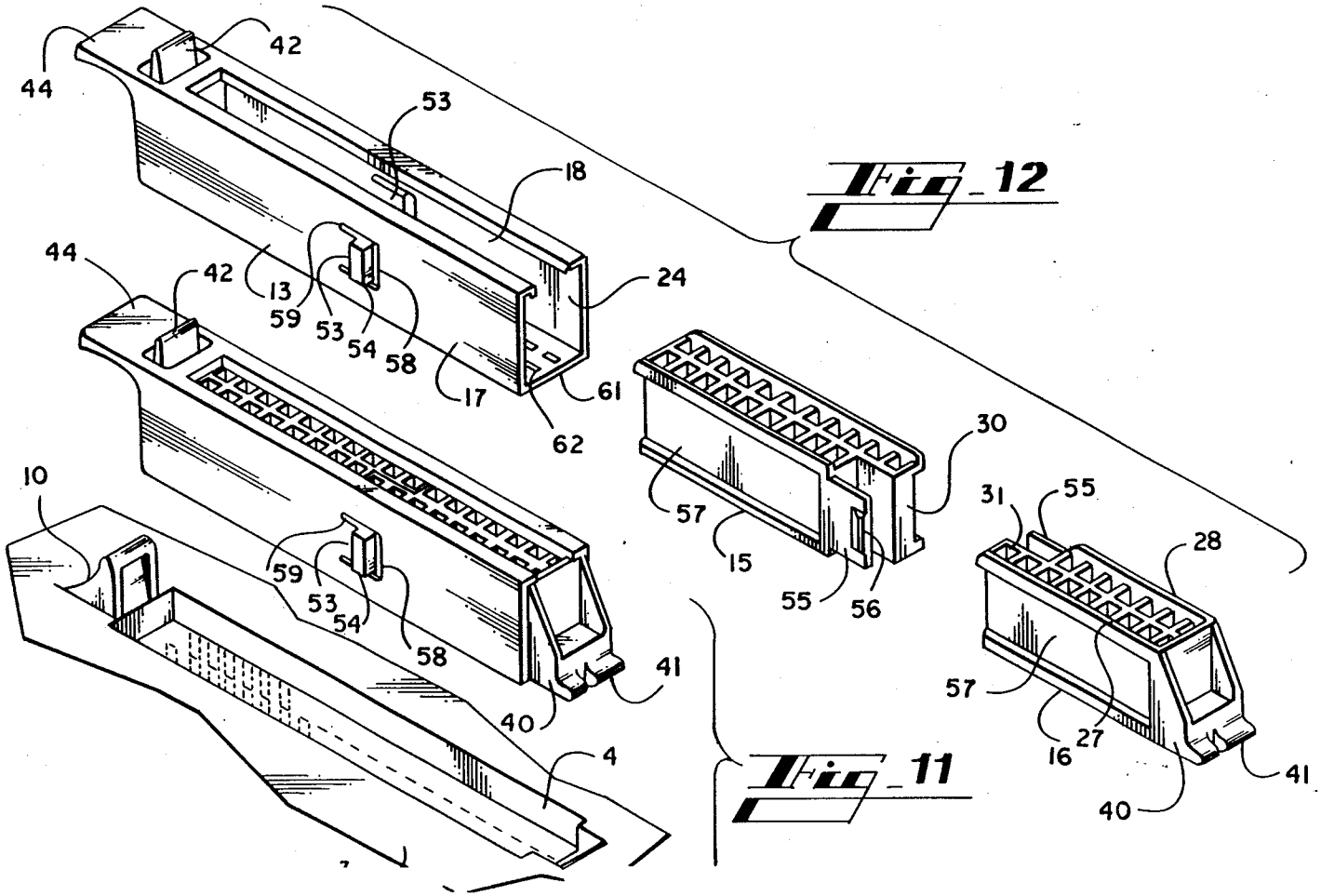
FIG. 11 shows an exploded diagram of another version of the plug and socket device.
FIG. 12 shows an exploded diagram of the plug enclosure of the plug and socket device according to FIG. 11.

FIGS. 11 and 12 show another interlocking or catch-lock mechanism for magazines 15, 16. To this end spring tongues 53 are mutually exposed in side walls 17, 18 and extend in the direction of insertion orifice 24 and have a grip piece 54 projecting over the outside surface of walls 17, 18 on the outside. Spring tongues 55 with catch noses 56 on the outside are provided on side walls 27 and 28 so they are opposite projections 30, 31 and practically forming an extension of the side walls approximately as long as projections 31 and function as mating catch devices on magazines 15, 16. Furthermore, rectangular recesses 57 are provided in side walls 27, 28 and are deeper than the thickness of spring tongues 55. When a magazine 15 or 16 is inserted into the interior 14 of plug enclosure 13, catch noses 56 spring behind the front edge 58 of recess 59. By pivoting the respective spring tongue 53 toward the interior 14, catch nose 56 is pressed inward so far that the catch edge 58 releases catch nose 56 because recess 57 permits such a pivoting movement of the catch spring tongues 55.

Figures 13, 14:
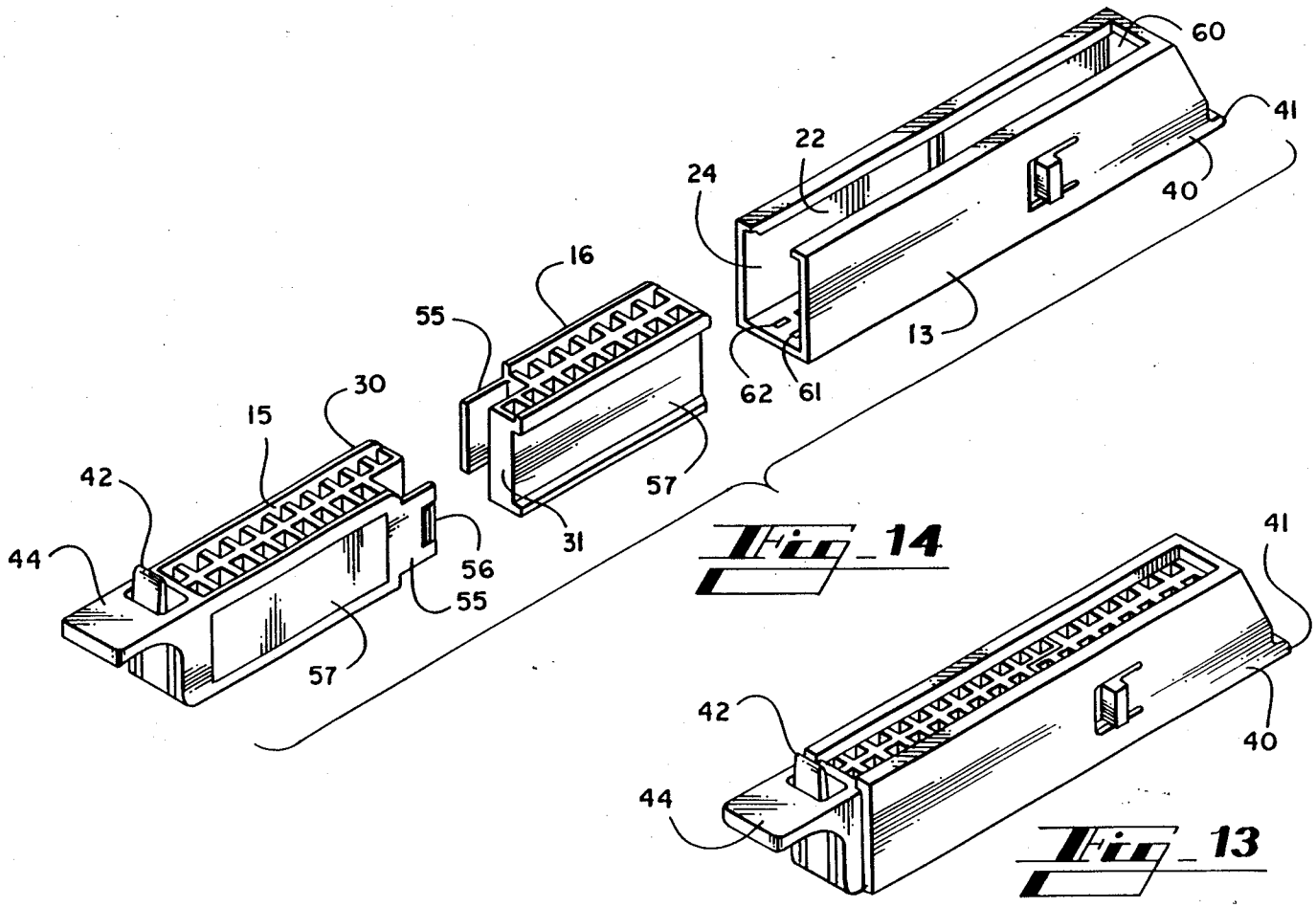
FIG. 13 shows a perspective diagram of a third version of a plug enclosure.
FIG. 14 shows an exploded diagram of the plug enclosure according to FIG. 13.

The version of plug 1 according to FIG. 13 and 14 shows that the insertion orifice 24 can also be provided on the rear end of the plug enclosure. In this case a stop such as a front wall 60 is provided at the front end for magazines 15, 16 and hinge tongue 40 on the outside on front wall 60 on housing 13. The interlocking devices on the magazine in housing 13 correspond to the interlocking devices according to FIGS. 11 and 12, but magazine 15 has grip plate 44 and catch spring tongue 42 on the rear end.

The versions of plug enclosure 13 according to FIGS. 11 to 14 do not have any lower recess 23 but instead they have a bottom wall 61 with holes 62 for the contact pins 6 to reach through. Plug enclosure 13 has greater torsional rigidity in these versions.

This invention has been explained on the basis of plug enclosure 13 as an example. It is of course also possible to implement this invention additionally or exclusively on the socket box enclosure.

I claim:

1. Multipole electric plug and socket device including a plug enclosure and a socket box enclosure each having a front and a rear and in which contact elements and mating contact elements attached to electric lines are accommodated in corresponding compartments, where the enclosures can be connected to a pivot hinge device and can be locked with a catch mechanism opposite the pivot hinge device, and box-shaped magazines each having at least one compartment for the contact elements can be inserted into the box-shaped interior of the plug enclosure or the socket box enclosure or both such enclosures, and the magazines have catch lock devices that lock with mating catch devices on the enclosure walls, characterized in that at least one of the plug enclosure (13) and the socket box enclosure (3) have an insertion orifice (24) at either the front or the rear for insertion of at least one magazine (15, 16), the insertion orifice being adapted to the form and size of the magazine (15, 16), and that side walls (17, 18) of the plug enclosure extend forwardly from the rear wall (19) in a fork shape, and the side walls 917, 18) have angle bars (20) that are designed identically toward an interior space (4) at the top and bottom of the side walls and define angle recesses 921) facing toward the interior (14), the plug enclosure (13) is open between the upper angle bars (2)) and the lower angle bars (21) of the plug enclosure 913), and the box-shaped magazine (15, 16) has bar pieces 929) that are open toward the top and bottom in an extension of its side walls 927, 28) and fit so as to lock in the angle recesses 921) of angle bars (20) and free end edges (20*a*) of the angle bars (20) rest on upper edges 925*a*) of the walls of the compartments (25).

2. Electric plug and socket device according to claim 1, characterized in that at least two magazines (15, 16) are arranged in an extensible manner axially to the insertion orifice (24).

3. Plug and socket device according to claim 2, characterized in that one magazine (15) has a projection (30) that runs parallel with the longitudinal axis and forms a first half and another magazine (16) has a projection (31) that forms the mating half so when themagazines are placed together, they interlock to form the box shape of the magazine.

4. Plug and socket device according to claim 3, characterized in that the projections (30 and 31) are provided with compartments (25).

5. Plug and socket device according to claim 3, characterized in that tabs (32) with catch holes (33) are provided on the front end of the side walls (17, 18) of the plug enclosure (13) and form one part of the interlocking mechanism for the magazines (15, 16) where the other part consists of tabs (34) that are attached to the side walls (27, 28) of the magazine (16) at the front and have catch noses (35) on the outside that lock in the catch holes (33).

6. Plug and socket device according to claim 5 characterized in that grip pieces (36) are provided on the ends of the tabs (34) and run across the tab, forming a slit (37) between the tab.

7. Plug and socket device according to claims 5 or 6, characterized in that the tabs (32 and 34) do not cover the entire width of the walls (17, 18) and (27, 28) and a hinge tongue (40) with a mating hinge piece (41) extending toward the front is located beneath the tabs (34) so the mating hinge piece (41) can lock under a hinge piece (9) of the socket box enclosure (3).

8. Plug and socket device according to claim 1, characterized in that the socket box enclosure (3) has a catch block (10) on the rear end, and the plug enclosure (13) is provided with a spring tongue (42) that projects freely upward from the bottom with a catch nose piece (43) on the rear end, and the catch nose piece (43) locks in an undercut (12) on the catch block (10).

9. Plug and socket device according to claim 8, characterized in that a grip plate (44) that extends toward the rear is molded on the rear end of the plug enclosure (13) and has a hole (45) through which the upper part of spring tongue (42) passes.

10. Plug and socket device according to claim 3, characterized in that the magazines (15, 16) are designed identically and a closing wall (46) assumes the closing and locking mechanism function for the magazine with the plug enclosure (13).

11. Plug and socket device according to claim 10, characterized in that the closing wall (46) has two vertical angle bars (47) extending in the direction of the enclosure (13), a stop piece (48) projecting in the direction of the enclosure (13) is provided on the lower edge of the closing wall (46), a catch spring tongue (49) with a catch spring nose (50) is provided in the area of the upper edge, the closing wall (46) has hinge tongue (40) n the outside, and vertical bar pieces 951) running across the longitudinal extent of the enclosure and extending outward to lock into bar recesses (47*a*) of angle bars (47) are provided as the outer support for the closing wall (46) on the end of the side walls (17, 18).

12. Plug and socket device according to claim 3, characterized in that spring tongues (53) are provided opposite each other for interlocking the magazines (15, 16) in the side walls (17, 18) and extend in the direction of the insertion orifice (24) and have a grip piece (54) projecting over the outside surface of the walls (17, 18) on the outside so that the spring tongues (55) serve as mating catch devices on the magazines (15, 16) with catch noses (56) on the outside provided on the side walls (27, 28) opposite the projections (30, 31) and practically forming an extension of the side walls which is approximately as long as the projections (30, 31), and rectangular recesses (57) that are deeper than the thickness of the spring tongues (55) are provided in the side walls (27, 28).

13. Plug and socket device according to claim 3, characterized in that the insertion orifice (24) is provided on the rear end and a stop (60) is provided on the front end, and a hinge tongue (41) is provided on the outside of the front wall (60) on the housing (13) and said catch device comprise the catch devices for the magazines in the enclosure (13).

14. Plug and socket device according to claim 13, characterized in that the magazine (15) has a grip plate (44) and catch spring tongue (42) on the rear end.

15. Plug and socket device according to claim 1, characterized in that the plug enclosure (13) has a bottom wall (61) with holes (62) for contact pin (6) to pass through.

* * * * *